US007434510B2

(12) United States Patent
Messmer et al.

(10) Patent No.: US 7,434,510 B2
(45) Date of Patent: Oct. 14, 2008

(54) METHOD FOR CLEANING THE SCREEN STENCIL OF A SILK-SCREEN PRINTING DEVICE

(75) Inventors: Klaus Messmer, Freiburg (DE); Ewald Koenig, Wyhl (DE); Dietmar Weber, Reute (DE)

(73) Assignee: Thieme GmbH & Co. KG, Teningen (DE)

( * ) Notice: Subject to any disclaimer, the term of this patent is extended or adjusted under 35 U.S.C. 154(b) by 0 days.

(21) Appl. No.: 10/536,795

(22) PCT Filed: Oct. 16, 2003

(86) PCT No.: PCT/EP03/11475

§ 371 (c)(1),
(2), (4) Date: Dec. 30, 2005

(87) PCT Pub. No.: WO2004/048098

PCT Pub. Date: Jun. 10, 2004

(65) Prior Publication Data

US 2006/0180037 A1 Aug. 17, 2006

(30) Foreign Application Priority Data

Nov. 27, 2002 (DE) ..... 102 56 326

(51) Int. Cl.
*B41F 35/00* (2006.01)
*B41F 15/12* (2006.01)

(52) U.S. Cl. ..... 101/424; 101/425; 101/123; 101/129

(58) Field of Classification Search ..... *B41F 15/12*
See application file for complete search history.

(56) References Cited

U.S. PATENT DOCUMENTS

| | | | | |
|---|---|---|---|---|
| 3,986,450 | A * | 10/1976 | Zimmer | 101/115 |
| 5,099,758 | A * | 3/1992 | Hassler et al. | 101/120 |
| 6,237,484 | B1 | 5/2001 | Hitachi | |
| 6,502,506 | B2 * | 1/2003 | Endo et al. | 101/118 |

FOREIGN PATENT DOCUMENTS

| | | | |
|---|---|---|---|
| DE | 196 05 846 | A1 | 8/1996 |
| DE | 196 05 058 | C2 | 11/1999 |
| DE | 199 17 794 | C2 | 8/2001 |
| JP | 57 167 269 | A | 10/1982 |

(Continued)

OTHER PUBLICATIONS

International Search Report, Feb. 18, 2004.

(Continued)

*Primary Examiner*—Leslie J Evanisko
(74) *Attorney, Agent, or Firm*—Crowell & Moring LLP

(57) ABSTRACT

A cleaning method for the screen stencil of a silk-screen printing machine. According to the method, prior to an intermediate printing process designed to clean the screen stencil, the underside of the stencil is wetted with a cleaning agent that dissolves dye. An intermediate printing device includes an intermediate printing roll that can be displaced back and forth. A rotating roll that is immersed in a cleaning bath is situated at the front end of the intermediate printing roll. The rotating roll can be brought into contact with the underside of the screen stencil prior to the intermediate printing process by means of a pivoting device.

2 Claims, 3 Drawing Sheets

FOREIGN PATENT DOCUMENTS

| | | | | |
|---|---|---|---|---|
| JP | 10180981 | | | 7/1998 |
| JP | 10217433 | | | 8/1998 |
| JP | 10 250 043 | A | | 9/1998 |
| JP | 11 058 699 | A | | 3/1999 |
| JP | 11198354 | A | * | 7/1999 |
| JP | 11 254 655 | A | | 9/1999 |
| JP | 2002254608 | A | * | 9/2002 |
| JP | 2003266647 | | | 9/2003 |

OTHER PUBLICATIONS

German Search Report Dated Jul. 24, 2003 (Four (4) Pages), With English Translation of Relevant Portion.

* cited by examiner

METHOD FOR CLEANING THE SCREEN STENCIL OF A SILK-SCREEN PRINTING DEVICE

This application is a continuation of International application PCT/EP2003/011475, filed Oct. 16, 2003 and claims the priority of German application No. 102 56 326.8, filed Nov. 27, 2002, the disclosure of which are expressly incorporated by reference herein.

BACKGROUND AND SUMMARY OF THE INVENTION

This invention relates to a method for cleaning the screen stencil of a screen printing device in which a sheet of paper is placed beneath the screen stencil for an intermediate printing and is printed by a squeegee passing over the stencil. This invention also relates to a screen printing machine for performing this method.

A cleaning method and a screen printing machine suitable for performing the cleaning method are known from DE 199 17 794 C2. With this known machine, the intermediate printing table is designed as a table that can be pivoted parallel to the guide path of the printing table and which is below the guidance of the printing table during the printing process and is pivoted upward for the purpose of cleaning beneath the screen stencil for the intermediate printing.

Machines of this type function satisfactorily but cannot prevent the disadvantage that the screen printing ink may dry out in part and clog the screen. Therefore despite the arrangement of an intermediate printing table which is used for cleaning the screen, it is still necessary with screen printing devices to stop production to clean the screen.

The object of the present invention is to perform such a cleaning operation automatically for the most part and to perform it during operation to avoid production downtime. At the same time, better working conditions are to be created and rejects are to be prevented.

To achieve this object, it is provided that before performing the intermediate printing, the bottom side of the screen stencil is wetted with a cleaning agent. Due to this measure, even ink residues that have already dried are dissolved from the screen; these residues could not have been removed from the screen stencil through the measure of an intermediate printing, which is performed by moving the squeegee mechanism onto an intermediate printing paper which is then rolled up and removed.

In another embodiment of the inventive method, wetting is performed by a rotating cylinder or brush which is brought into contact with the bottom side of the screen stencil and is immersed in a cleaning fluid. Due to the rotation of the cylinder or brush, the cleaning agent is conveyed out of the bath and brought to the bottom side of the screen stencil, where it can loosen dried-on ink residues which can then be removed in the intermediate printing.

This invention also relates to a screen printing machine for performing the cleaning method, whereby the screen printing machine is equipped with an intermediate printing device with which a sheet of paper can be introduced beneath the screen stencil for the purpose of cleaning. The new screen printing machine is characterized by a rotating body assigned to the intermediate printing device and arranged across the direction of movement of the intermediate printing device, said rotating body being coatable with a cleaning agent and coming in contact with the bottom side of the screen stencil before the intermediate printing and being guidable along the stencil.

Due to this design, the cleaning can be performed automatically and in the screen printing machine.

In an embodiment of this invention, a cylinder which is immersed in a bath of cleaning agent may be provided as the rotating body.

In a refinement of this invention, this cleaning agent may be present in a container that surrounds the bottom of the cylinder and is adapted to the shape of the cylinder, in which case the cylinder is designed with a roughened surface to retain a sufficiently thick layer of cleaning agent and to be able to bring it against the screen stencil.

In a refinement of this invention, the cylinder is driven in a rotating manner and to this end engages in a toothed rod with pinion gears arranged at the side next to the screen stencil on the printing machine.

The intermediate printing device itself is designed so that it can be raised and lowered and thus can be folded up and unfolded in which case a control device may be provided for determining the cleaning cycle so that, for example, a cleaning printing operation is performed after every second, third or fourth printing.

In an advantageous refinement, the cylinder and the container assigned to it to which the cleaning agent is supplied in circulation in a simple manner are arranged on the end of a paper impression cylinder mounted displaceably in the direction of movement of the squeegee, where said end of the cylinder faces the screen stencil.

To implement the possibility of raising and lowering the cleaning agent cylinder, the cylinder together with the container may expediently be arranged on a pair of swivel levers that can be acted upon by pneumatic cylinders so that the lateral pinion gears of the cylinder engage in the toothed rod which runs fixedly next to the screen stencil. Finally, in an essentially known manner, the intermediate impression cylinder may be provided with paper and arranged so that it can be moved at least by the length of the screen stencil, so that before the intermediate printing the entire underside side of the screen stencil is wettable with a cleaning agent. In practice, it is sufficient to wet the stencil in the printing area.

Instead of the intermediate impression cylinder with an unrolling web of paper, an endless sheeting material may also be used to accommodate the intermediate printing or a plate cylinder may be used. In both variants, continuous cleaning of the continuous loop or the plate cylinder may be ensured. Then there is no consumable material in the form of paper.

Other objects, advantages and novel features of the present invention will become apparent from the following detailed description of the invention when considered in conjunction with the accompanying drawings for example.

DETAILED DESCRIPTION OF THE DRAWINGS

Figure 1:
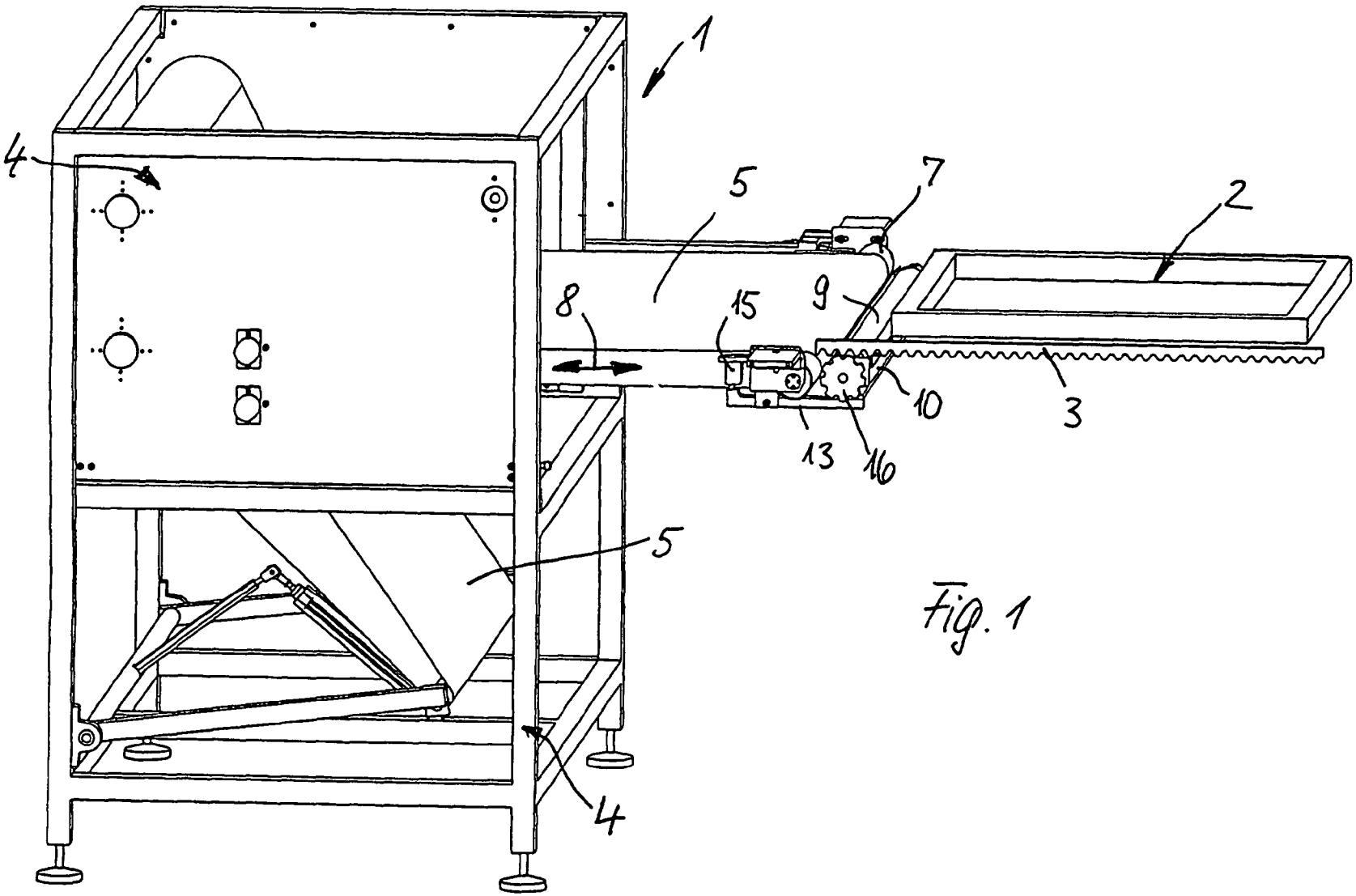
FIG. 1 shows a schematic perspective diagram of an intermediate printing device according to an embodiment of this invention and its correlation with the screen stencil of a screen printing machine, whose printing table and squeegee mechanism are not shown.

FIG. 1 shows an intermediate printing device 1 which is assigned to a screen printing machine (not shown). Of the screen printing machine, the screen stencil 2 which is held in a frame is shown here; it is arranged in a known manner between an intermediate impression cylinder that can be moved beneath it and a squeegee mechanism arranged above it (not shown). In addition, a toothed rod 3 which is arranged to run laterally and parallel to the longitudinal direction of the screen stencil 2 and will be discussed in greater detail below is fixedly connected to the screen printing machine.

The intermediate printing device 1 is equipped with a paper web 5 within a carrying frame 4; this paper web is pulled off a cylinder and guided over an intermediate impression cylinder 7 and back beneath it again to a second cylinder. The paper web 5 is guided here within the carrying frame 4 in such a way that it can also execute a back and forth movement of the intermediate impression cylinder 7 in the direction of arrows 8.

Figure 2:
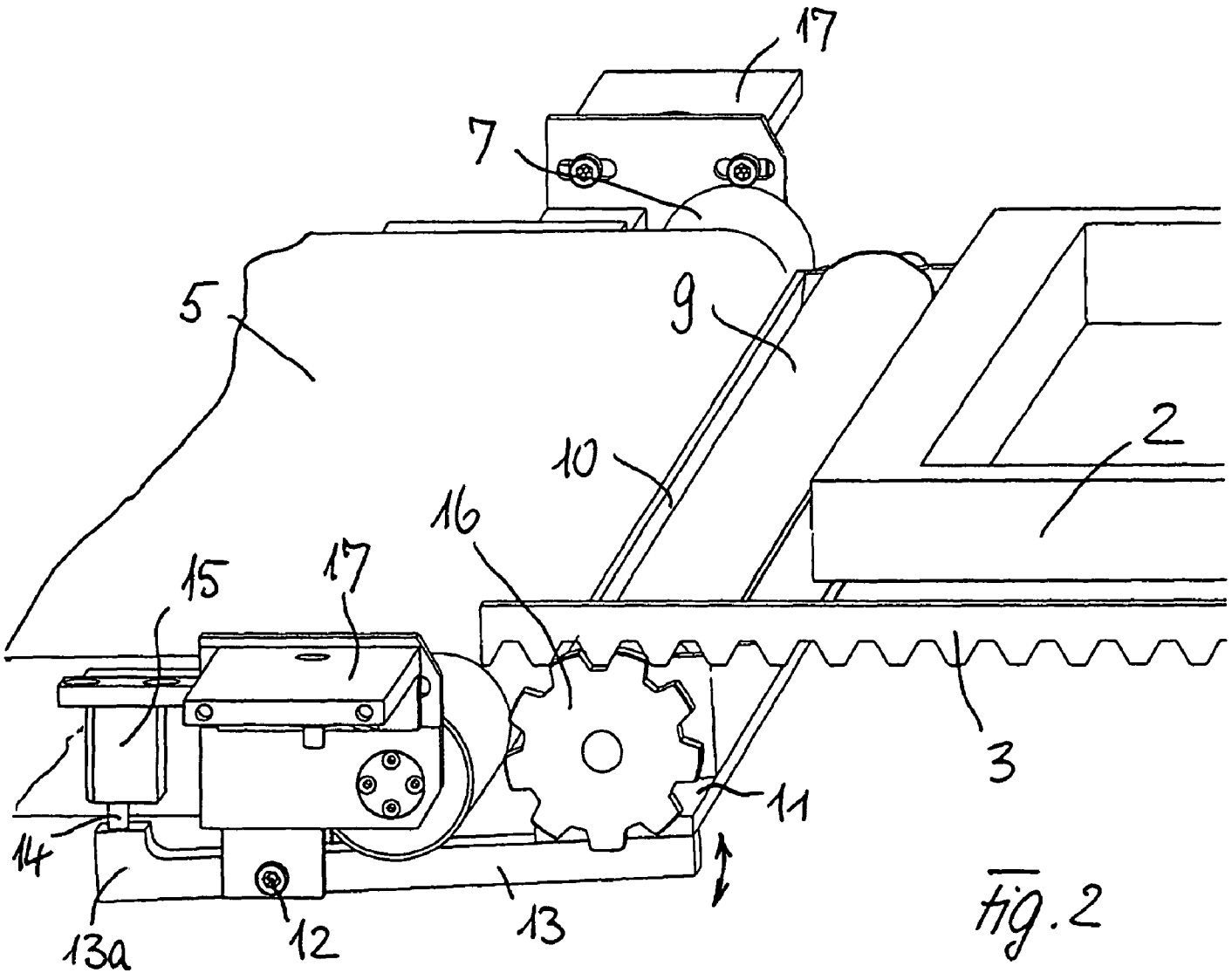
FIG. 2 shows an enlarged diagram of the end of the intermediate printing device according to FIG. 1 facing the screen stencil but in a position in which the intermediate printing device is in the process of being run beneath the screen stencil to perform an intermediate printing.

Upstream from the intermediate impression cylinder 7, a cylinder 9 is arranged running across the path of movement of the intermediate impression cylinder 7; as indicated in the enlarged diagram in FIG. 2, this cylinder is immersed in a container 10 which largely surrounds it and is filled with a liquid cleaning agent. This is a cleaning agent capable of dissolving the ink used in screen printing.

The container 10 and the cylinder 9 guided in it are mounted on a transverse web 11, which is mounted at the right end by a double lever 13 pivotable about the axle 12. The other lever arm 13*a* of the double lever is in contact with the tappet 14 of a pneumatic cylinder 15 which makes it possible to pivot the double lever 13 upward and downward out of the position illustrated in FIG. 1.

The cylinder 9 is provided with a pinion gear 16 on one end on which it is mounted via bearing journals, each in one end wall of the container 10; on operation of the cylinder 15 and on pivoting of the double lever 13 counterclockwise, this pinion gear engages with the toothed rod 3 as also illustrated in FIG. 2.

The intermediate impression cylinder 7 protruding out of the carrying frame 4 has a bearing and two laterally protruding straps 17 which can be brought into operative engagement with the squeegee mechanism (not shown) and/or with the drive thereof.

Figure 3:
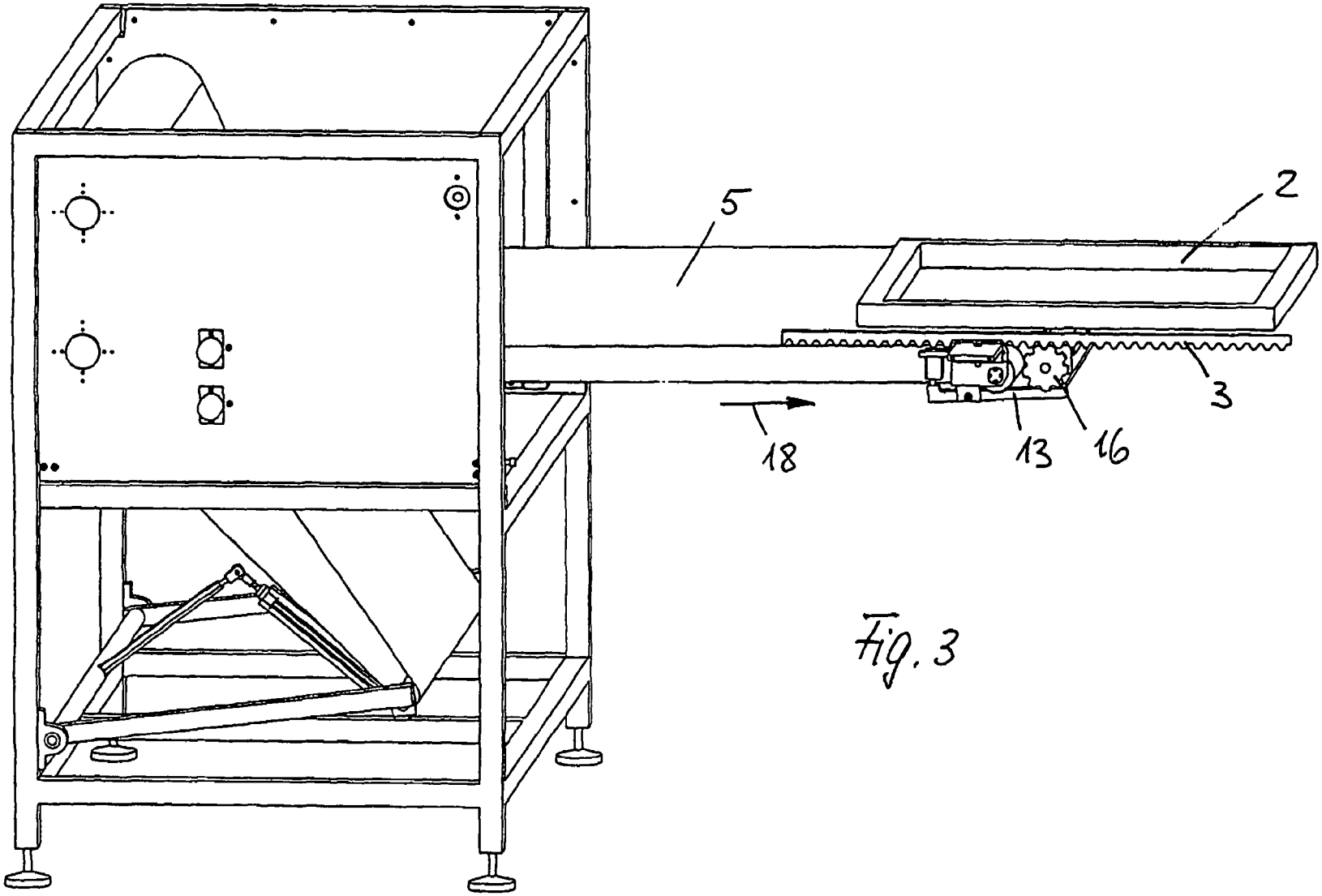
FIG. 3 shows a diagram like that in FIG. 1, as the underside of the screen stencil is being wetted-with a cleaning agent.

The operation of the intermediate printing device is as follows:

After a predetermined number of printing operations in the screen printing machine, a pulse is delivered via a corresponding control device, resulting in the intermediate impression cylinder 7 being moved beneath the screen stencil of the screen printing machine in the return motion of the squeegee mechanism, as illustrated in FIG. 3. Previously, the double lever 13 has been pivoted counterclockwise by cylinder 15 due to the pulse, so that the cleaning agent cylinder 9 with its pinion gears 16 engages with the toothed rod mounted fixedly next to the screen stencil 2. In the movement of the intermediate impression cylinder in the direction of the arrow 18 (FIG. 3), the counterclockwise rotating cylinder 9 is guided past the screen stencil 2, so that it comes in contact with the underside of the screen stencil 2. Therefore, as the cylinder 9 slides along the bottom side of the screen stencil 2, it wets the screen stencil 2 with a cleaning agent that is conveyed out of the container 10 due to the rotation of the cylinder 9. The cleaning agent is also circulated through the container 10 in a manner not illustrated further here so that the level of the cleaning agent in the container 10 can always be kept the same. Due to the wetting of the screen stencil with the cleaning agent, ink residues are dissolved from the screen stencil, even if the ink is already partially dried. The cylinder 9 may be passed once or more along the bottom side for wetting the bottom of the screen stencil so that the required wetting is accomplished in any case. The intermediate impression cylinder 7 is to this end moved back and forth by the drive of the squeegee mechanism as often as necessary.

If the wetting is complete and has been continued long enough, then the intermediate impression cylinder 7 slides with the paper web 5 completely under the screen stencil 2 and after lowering the squeegee mechanism, the remaining ink is printed out on the paper web 5 which is then pulled off accordingly and rolled up as waste. Dried-on ink residues are also removed from the screen stencil 2 in this cleaning.

Then the normal printing operation is again begun. Through appropriate control, it is possible after a certain number of printings to perform a cleaning again, whereby after a predetermined number of printings, the wetting of the bottom side of the screen stencil can also be accomplished automatically by passing the cylinder 9 once along the screen stencil or even repeated many times back and forth along the bottom of the screen stencil 2.

Once the wetting operation of the bottom side of the screen stencil is concluded, the pinion gear 16 is removed from the toothed rack 3 by pivoting the double lever 13 clockwise so that the screen stencil 2 is no longer being wetted for the cleaning printing itself and for the corresponding return movement of the intermediate impression cylinder 7.

This invention offers a very simple possibility of cleaning a screen stencil 2 of a screen printing machine which takes place automatically. The device is largely maintenance-free and allows cleaning of the screen without any mentionable production downtime.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Method for cleaning a screen stencil of a screen printing device, comprising the steps of:

bringing a paper web beneath the screen stencil for an intermediate printing; and printing on the paper web by a squeegee running over the screen stencil, wherein before performing the intermediate printing, the bottom of the screen stencil is wetted with a cleaning agent by a rotating cylinder or brush that is immersed in cleaning agent and brought in contact with the bottom of the screen stencil, the rotating cylinder or brush being mounted to be raised or lowered and arranged across a direction of movement of the intermediate printing device, the rotating cylinder or brush rotates without slippage along the bottom of the screen stencil, and said paper web is different from a media to be printed on in regular printing on the screen printing device.

2. Method for cleaning a screen stencil of a screen printing device, comprising the steps of:

wetting a bottom of the screen stencil with a cleaning agent;

bringing a paper web beneath the screen stencil for an intermediate printing while the cleaning agent is present on the bottom of the screen stencil; and printing on the paper web by a squeegee running over the screen stencil, wherein before performing the intermediate printing, the bottom of the screen stencil is wetted with a cleaning agent by a rotating cylinder or brush that is immersed in cleaning agent and brought in contact with the bottom of the screen stencil, the rotating cylinder or brush being mounted to be raised or lowered and arranged across a direction of movement of the intermediate printing device, the rotating cylinder or brush rotates without slippage along the bottom of the screen stencil, and said paper web is different from a media to be printed on in regular printing on the screen printing device.

* * * * *